US005806173A

United States Patent [19]

Honma et al.

[11] Patent Number: 5,806,173

[45] Date of Patent: Sep. 15, 1998

[54] TUBE EXPANDER

[75] Inventors: Kensaku Honma; Yoshihiro Baba, both of Tokyo, Japan

[73] Assignee: Hidaka Seiki Kabushiki Kaisha, Tokyo, Japan

[21] Appl. No.: 681,468

[22] Filed: Jul. 23, 1996

[30] Foreign Application Priority Data

Jul. 28, 1995 [JP] Japan ..... 7-192782

[51] Int. Cl.[6] ..... B23P 15/26

[52] U.S. Cl. ..... 29/727; 29/726

[58] Field of Search ..... 29/727, 726, 523, 29/890.043, 890.047

[56] References Cited

U.S. PATENT DOCUMENTS

| | | | |
|---|---|---|---|
| 4,597,171 | 7/1986 | Kitayama et al. . | |
| 4,779,333 | 10/1988 | Rabe et al. | 29/727 |
| 4,779,445 | 10/1988 | Rabe | 72/393 |
| 4,780,955 | 11/1988 | Stroup | 29/727 |
| 4,839,950 | 6/1989 | Stroup | 29/523 |
| 5,097,590 | 3/1992 | Tokura | 29/727 |
| 5,640,879 | 6/1997 | Damsshn et al. | 72/479 |

FOREIGN PATENT DOCUMENTS

| | | |
|---|---|---|
| 60-34332 U | 3/1985 | Japan . |
| 63-188433A | 8/1988 | Japan . |

*Primary Examiner*—Irene Cuda
*Attorney, Agent, or Firm*—Birch, Stewart, Kolasch & Birch, LLP

[57] ABSTRACT

In forming a heat exchanger, a tube of the heat exchanger is expanded by a bullet, which is attached to a mandrel. The tube is projected from both end faces of a piled body formed by piling a plurality of fins. Each fin has a tube hole through which the tube passes. The fins and the tube are integrated by expansion of the tube. A first projected section of the tube, which is projected from one end face of the piled body and which has been expanded by the bullet, is held at a prescribed position. The bullet is pressed toward a second projected section, which is projected from the other end face of the piled body. As the bullet moves toward the second projected section, it expands the tube. The second projected section of the tube is allowed to contract during the tube expansion. An object of the present invention is to prevent adhesion of adjacent fins and irregularities in fin clearances between adjacent fins.

7 Claims, 11 Drawing Sheets

TUBE EXPANDER

BACKGROUND OF THE INVENTION

The present invention relates to a tube expander and a method of expanding a tube. More precisely the present invention relates to a tube expander and a method of expanding a tube, in which a heat exchange tube is expanded by a bullet, which is provided to a front end of a mandrel; the bullet is inserted into the tube so as to expand the tube, which is projected from both end faces of a piled body formed by piling a plurality of fins, each of which has a tube hole through which the tube has been pierced; and the fins and the tube are integrated by expanding the tube pierced.

A conventional heat exchanger of a room air conditioner of a car air conditioner is shown in FIG. 12. In FIG. 12, the heat exchanger has a piled body 16 with height "H". The piled body 16 includes a pair of end plates 12*a* and 12*b* with length "W", and a plurality of fins 10, each of which has tube holes 14. The fins 10 are mutually piled with clearance or curl height "h". U-shaped heat exchanging tubes 18 are pierced through the piled body 16. Open ends of the tubes 18 are projected from one end face (an upper face) of the piled body 16. U-shaped parts 20 of the tubes 18 are projected from the other end face (a bottom face) of the piled body 16. U-bent tubes 22 are attached to the open ends of the tubes 18, which are projected from the one end face of the piled body 16, so as to mutually connect the tubes 18.

In the heat exchanger shown in FIG. 12, the fins 10 and the tubes 18 are integrated by expanding the tubes 18. The tube expansion is executed by a tube expander. One conventional tube expander is disclosed in U.S. Pat. No. 4,597,171. This conventional tube expander is shown in FIGS. 13A and 13B. FIG. 13A shows a state of starting the tube expansion. FIG. 13B shows a state of completing the tube expansion.

In the conventional tube expander, a press board 134 is reciprocatively moved by a press unit 132 having a hydraulic cylinder. Mandrels 155 are attached to the press board 134 with an attaching plate 154. Bullets 156 for expanding the tubes are attached to front ends of the mandrels 155. As shown in FIG. 13A, the bullets 156 are inserted into the tubes 18, which are pierced through the piled body 16 of the fins 10.

As shown in FIG. 13B, the press board 134 is moved downward by the press unit 132 until the bullets 156 are close to the U-shaped parts 20 (see FIG. 12) of the tubes 18. By the movement of the bullets 156, the tubes 18 are expanded.

While the tube expansion operation occurs, positions of the the U-shaped parts 20 are maintained by a holding plate 157. The plate 157 is fixed at a predetermined position during the tube expansion operation.

Note that, the open ends of the tubes 18 are further expanded to form enlarged sections. The enlarged sections are used to attach the U-bent tubes 22. This treatment is called a second treatment. After the second treatment, front ends of the enlarged sections are flared. This treatment is called a third treatment.

By the tube expander shown in FIGS. 13A and 13B, the fins 10 and the tubes 18 can be integrated by expanding the tubes 18.

The holding plate 157 has receiving sections 157A (FIGS. 14A and 14B), whose inner shapes correspond to the U-shaped parts 20 of the tubes 18. If a diameter of the tubes 18 or a curvature of the U-shaped parts 20 is changed, a new holding plate 157, whose receiving sections 157A correspond to the changed diameter or curvature, must be prepared.

Since the holding plate 157 is fixed at the predetermined position while the tube expansion operation occurs, the tubes 18 contract toward the open ends from which the bullets 156 have been inserted.

With the contraction toward the open ends, expanded parts 18' of the tubes, which have been integrated with the fins 10, contract. The fins 10 are moved or displaced as shown by a one-dot chain line 10' with the contraction of the expanded parts 18'(see FIG. 15), so that adhesion of adjacent fins 10 and irregularity of fin clearance are apt to occur. With the adhesion of the fins and the irregularity of the fin clearance, efficiency of the heat exchanger must be lowered.

SUMMARY OF THE INVENTION

An object of the present invention is to provide a tube expander and a method of expanding tubes, which are capable of easily expanding tubes and preventing the adhesion of adjacent fins and the irregularity of the fin clearance.

To achieve the object, the inventors thought that it is effective to contract non-expanded end sections of the tubes, which are separate away from the fins, when the bullets are inserted into the tubes for the tube expansion.

As the result of a study, the inventors discovered that the adhesion of the fins and the irregularity of the fin clearance can be prevented, while the bullets are inserted through the tubes for the tube expansion operation, by the steps of: expanding first projected sections of the tubes, which are projected from one end face of the piled body, with the bullets; holding the first projected sections, which have been expanded, to locate them at predetermined positions; and expanding remaining parts of the tubes with allowing contraction of second projected sections of the tube, which are projected from the other end face of the piled body.

Namely, the tube expander of the present invention comprises:

a mandrel; and a bullet being provided to a front end of the mandrel, the bullet being inserted into a heat exchanging tube so as to expand the tube, which is projected from both end faces of a piled body formed by piling a plurality of fins, each of which has a tube hole through which the tube has been pierced and whose diameter is greater than the diameter of the tube, wherein the fins and the tube are integrated by expanding the tube pierced;

holding means for holding a first projected section of the tube, which is projected from one end face of the piled body and which is expanded by inserting the bullet, so as to allow contraction of a second projected section of the tube, which is projected from the other end face of the piled body, while the bullet is inserted into the tube from the first projected section and pressed toward the second projected section to expand the tube; and press means for pressing the bullet, which has been inserted in the tube for tube expansion, from the first projected section expanded, which is held by the holding means, toward the second projected section not expanded.

And the method of expanding a heat exchange tube of the present invention comprises the steps of:

expanding the tube by a bullet, which is provided to a front end of a mandrel, wherein the bullet is inserted into the tube so as to expand the tube, which is projected from both end faces of a piled body formed by piling a plurality of fins, each of which has a tube hole through which the tube has been pierced and whose diameter is greater than the diameter of the tube, and wherein the fins and the tube are integrated by expanding the tube pierced;

holding a first projected section of the tube, which is projected from one end face of the piled body and which has been expanded by inserting the bullet therein from one end, to locate one end of the tube at a prescribed position; and pressing the bullet, which has been inserted in the tube for tube expansion, from the first projected section of the tube, which has been expanded, toward a second projected section thereof, which is projected from the other end face of the piled body and which is not expanded, wherein the second projected section of the tube is allowed to contract while the tube expansion.

In the tube expander, the tube may be a U-shaped tube, whose U-shaped part is the second projected section projected from the other end face of the piled body.

The tube expander may further comprise an inner sleeve being capable of being inserted into the tube so as to expand the first projected section of the tube, wherein diameter of the inner sleeve is increased and reduced by reciprocation of the bullet, and wherein diameter of the first projected section can be made greater than diameter of the tube hole.

With this structure, the second treatment of forming the enlarged section for attaching the U-bent tube 22 at the open end of the tube (see FIG. 12) can be omitted.

In the tube expander, the holding means may comprise:

a clamping chuck being formed into a cylindrical shape whose diameter can be reduced; and a clamping sleeve being slidably provided on an outer circumferential face of the clamping chuck, the clamping sleeve being capable of reducing the diameter of the clamping chuck, by sliding on the outer circumferential face, so as to clamp the first projected section of the tube, which has been expanded. With this structure, the expanded section of the tube can be held easily.

Further, the holding means may have a projected section being projected radially inward from an inner face of the clamping chuck. With this structure, the expanded section, which has been expanded by the clamping sleeve and the clamping chuck, can be held securely.

In the present invention, the first projected section of the heat exchanging tube, which has been expanded, can be held at the prescribed position while the tube is expanded.

And, the second projected section of the tube, which is projected from the other end face of the piled body, is a free end, so it is capable of contracting. Thus, the contraction, based on the tube expansion, of the tube, whose one end is held at the prescribed position, occurs in the second projected section. As shown in FIG. 15, the second projected section is a non-expanded section, so there is a gap 24 between the tube 18 and the inner face of the tube hole 14 of the fin 10. By the gap 24, even if the second projected section of the tube contracts, the fins are not moved with the contraction, and the adhesion of the adjacent fins can be prevented.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Embodiments of the present invention will now be descried by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
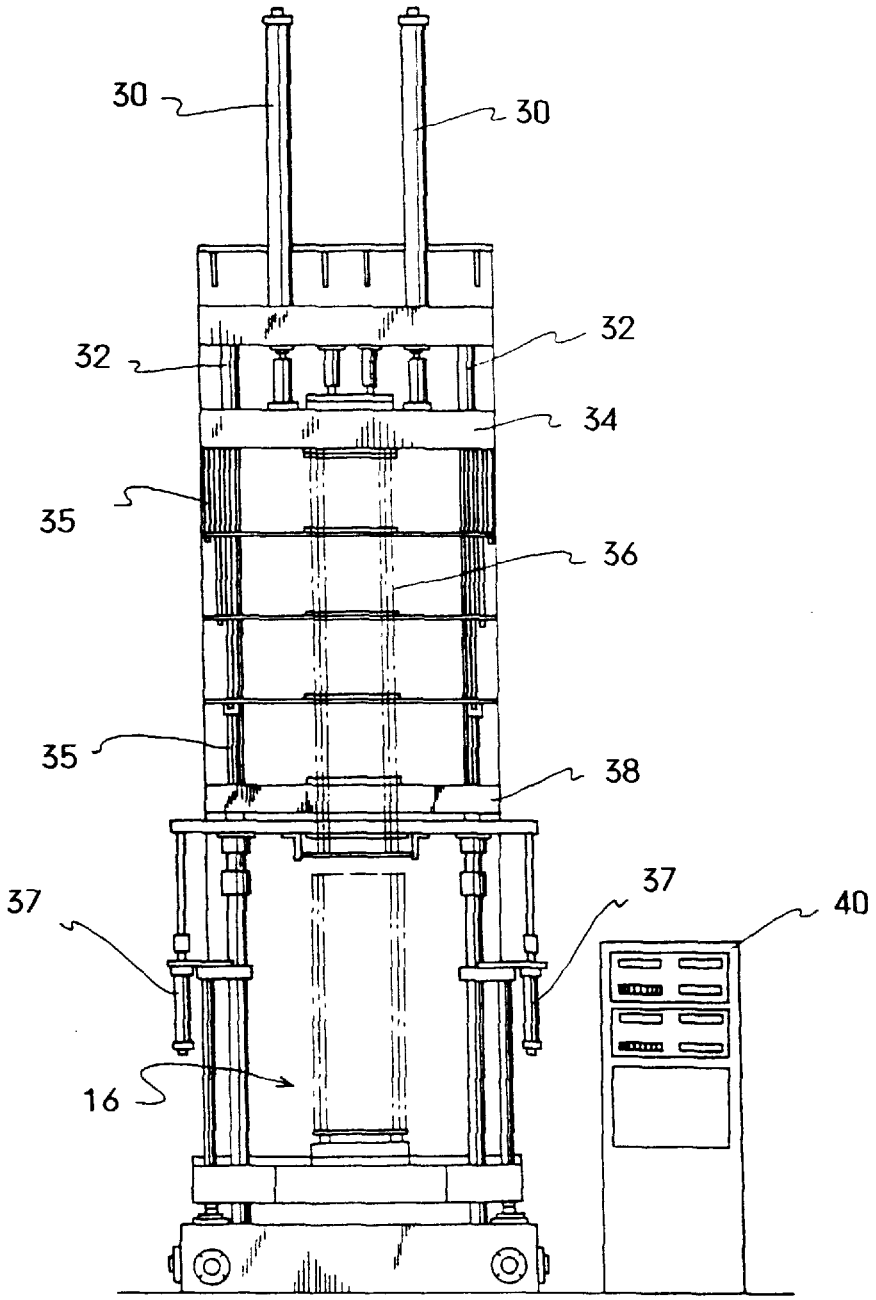
FIG. 1 is a front view of an embodiment of the tube expander of the present invention.

FIG. 1 is a front view of an embodiment of the tube expander of the present invention. In FIG. 1, a plurality of mandrels 36 are attached to a press board 34. The press board 34 is vertically moved along guides 32 by hydraulic cylinders 30. There are respectively provided bullets, whose diameter is greater than that of heat exchanging tubes to be expanded, to lower ends of the mandrels. The tubes are pierced through a base table 38, which is held at a prescribed position, and a piled body 16.

The base table 38 is suspended from the press board 34 by suspenders 35. The base table 38 is held at the prescribed position by balance cylinders 37 while the tubes are expanded.

Note that, operation states of the hydraulic cylinders 30, etc. are indicated on a control panel 40.

Figure 12:
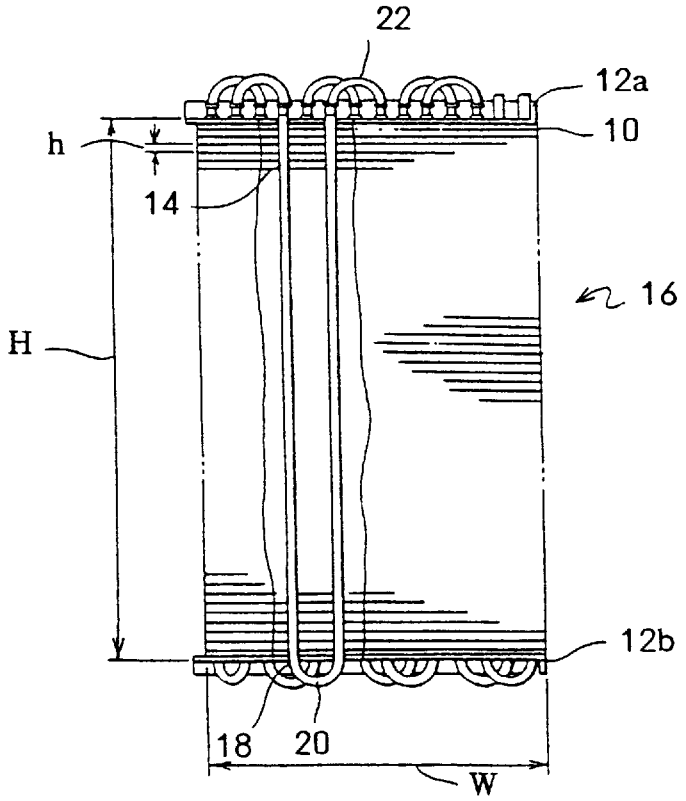
FIG. 12 is a partial sectional view showing a conventional heat exchanger.

In the tube expander shown in FIG. 1, the piled body 16 (see FIG. 2) is provided under the base table 38. As shown in FIG. 12, the piled body 16 is formed by piling a plurality of fins 10, each of which has tube holes 14. The heat exchanging tubes 18, each of which is formed into a U-shape, are pierced through the tube holes 14. A diameter of the tube holes 14 is greater than that of the tubes 18.

Figure 2:
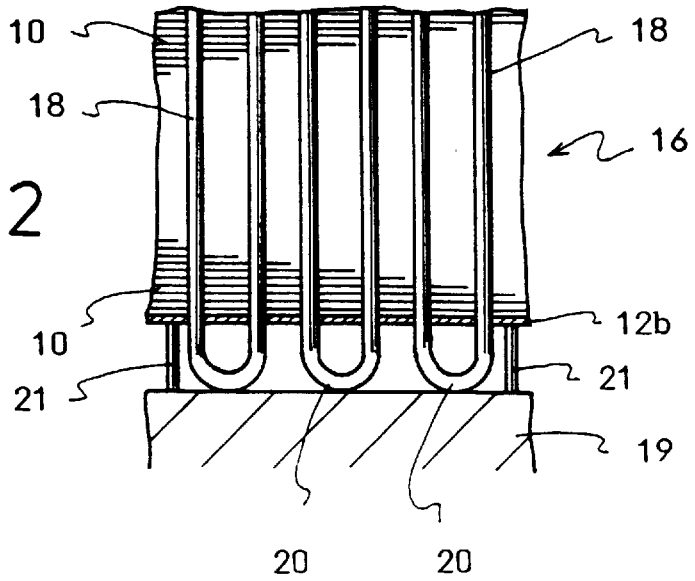
FIG. 2 is a view showing a holding plate of the tube expander shown in FIG. 1, which receives second projected sections of heat exchanging tubes pierced through a piled body.

As shown in FIG. 2, U-shaped parts 20 (the second projected sections) of the tubes 18 are projected from an end plate 12*b*, which constitutes a bottom face of the piled body 16. Since lower ends of the U-shaped parts 20 contact a flat face of a holding plate 19, their positions are defined.

Further, the end plate 12*b* of the piled body 16 contacts ends of pins 21, which are provided on the flat face of the holding plate 19. By this arrangement, the end plate 12*b* is also positioned at a prescribed position. With this structure, a projecting length of the U-shaped parts 20 can be defined. The pins 21 may be detachably screwed in the holding plate 19.

Figure 3:
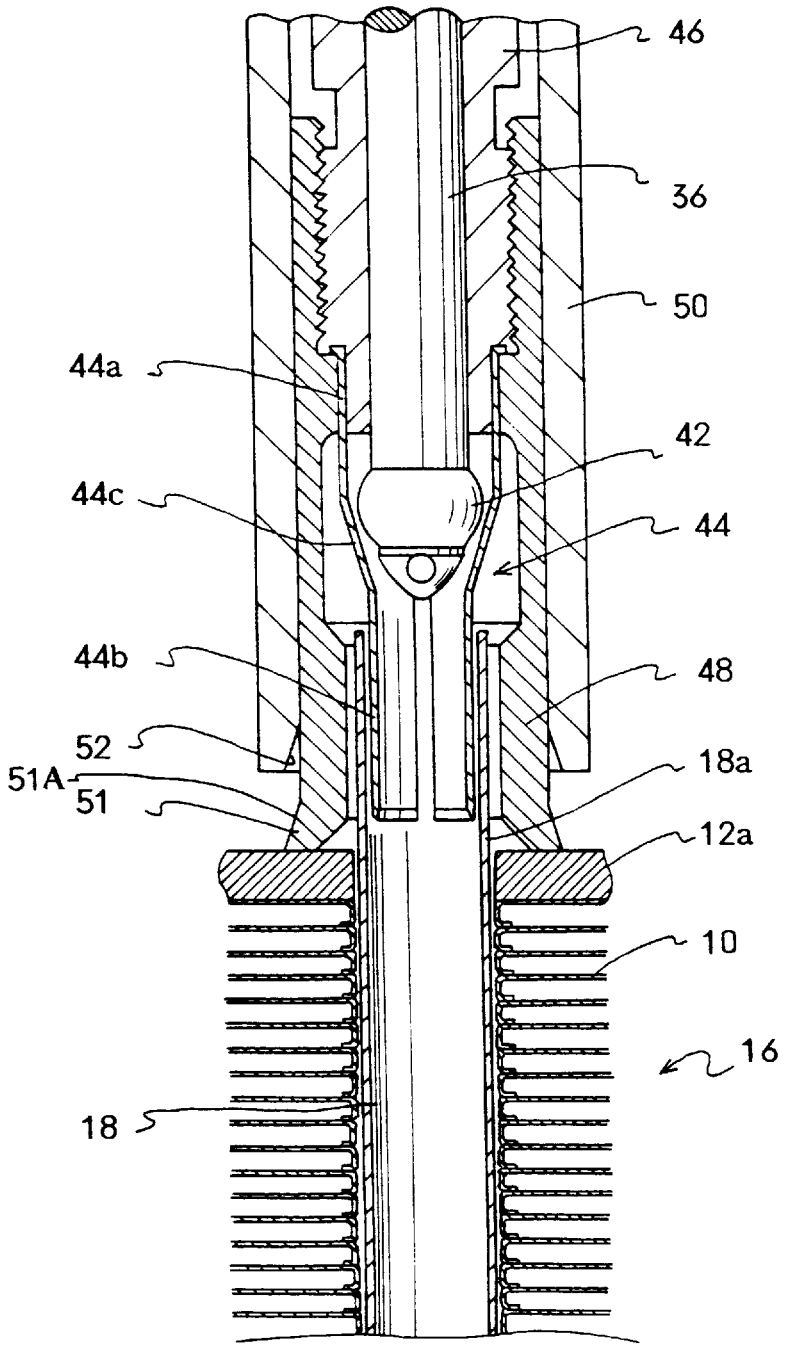
FIG. 3 is a partial sectional view of a holding unit of the tube expander shown in FIG. 1, which holds a first projected section of the tube.

On the other hand, upper end sections 18*a* (the first projected sections) of the tubes 18 are projected from an end plate 12*a*, which constitutes an upper face of the piled body 16 (see FIG. 3).

As shown in FIG. 3, a bullet 42, is attached to the lower end of the mandrel 36. The bullet 42 is moved close to the upper end section 18*a* of the tube 18. Then, a lower end section of a cylindrical inner sleeve 44, which is made of a spring steel having elasticity, is inserted into the upper end section 18*a*.

Figure 4A:
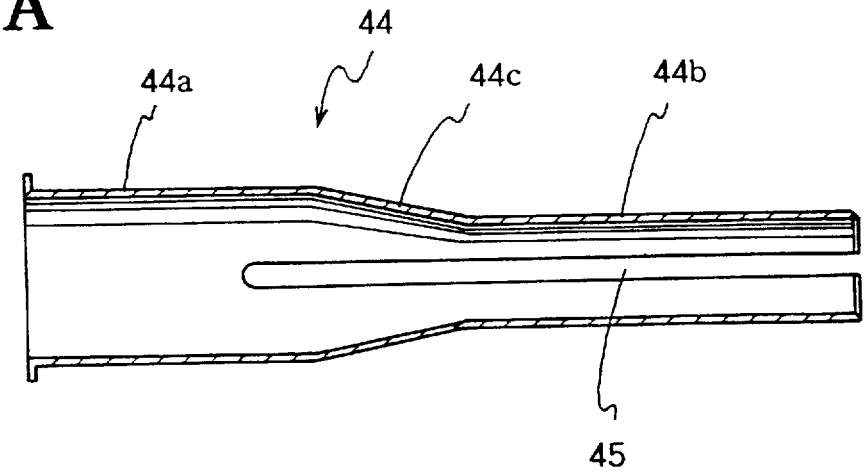
FIGS. 4A and 4B are sectional views of an inner sleeve of the holding unit shown in FIG. 3.

An upper end section of the inner sleeve 44 is fixed by a chuck holder 46. The chuck holder 46 is attached to the base table 38. The mandrel 36 passes through the chuck holder 46. A cylindrical clamping chuck 48 is screwed with the chuck holder 46. As shown in FIG. 4A, a diameter of a rear end section 44*a* of the inner sleeve 44 is greater than that of a front end section 44*b* thereof. The end sections 44*a* and 44*b* are connected with a tapered section 44*c*.

Note that, the inner diameter of the rear end section 44*a* is made greater than an outer diameter of the bullet 42 (see FIG. 3) so as to easily insert the bullet 42.

Figure 4B:
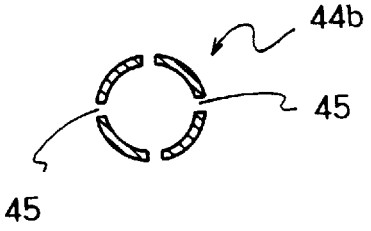

Further, as shown in FIG. 4A, slits 45 run from the front end section 44*b* to a front part of the rear end section 44*a* via the tapered section 44*c*. The slits 45 are arranged in the circumferential direction of the front end section 44*b* (see FIG. 4B: the transverse sectional view of the front end section 44*b*). With this structure, the inner diameter of the tapered section 44*c* and the front end section 44*b*, will have elasticity. The diameters can be easily reduced and increased when the bullet 42, which has been inserted in the rear end section 44*a*, is moved into and out of the tapered section 44*c* and the front end section 44*b*.

When the bullet 42 is inserted into the upper end section 18*a* of the tube 18, in which the front end section 44*b* of the inner sleeve 44 has been inserted, the inner diameter of the upper end section 18*a* is made greater than outer diameter of the bullet 42. The diameter difference therebetween is equal to a thickness of the front end section 44*b* of the inner sleeve 44. By adjusting the thickness of the front end section 44*b* of the inner sleeve 44, the U-bent tubes 22 (see FIG. 12) can be attached to the expanded upper end sections 18*a*, so secondary tube expansion of the upper end section 18*a* or the second treatment can be omitted.

Note that, the upper end sections (the enlarged end sections) 18*a*, whose inner diameters have been made greater than outer diameter of the bullets 42, act as connecting sections for connecting the U-bent tubes 22.

Figure 5:
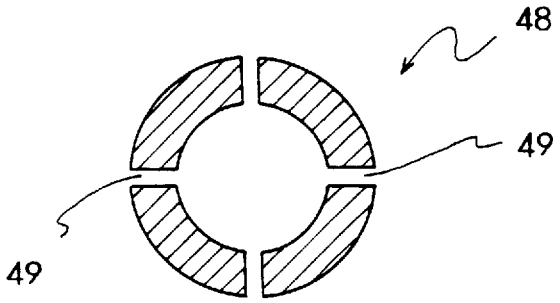
FIG. 5 is a transverse sectional view of a clamping chuck of the holding unit shown in FIG. 3.

The upper end section 18*a* of the tube 18, in which the front end section 44*b* of the inner sleeve 44 is inserted, is inserted into the clamping chuck 48. One end section of the clamping chuck 48 is screwed with the chuck holder 46. An inner diameter of a part of the clamping chuck 48, in which the upper end section 18*a* of the tube 18 is inserted, is greater than the outer diameter of the tube 18 when expanded. The diameter difference is equal to thickness of the front end section 44*b* of the inner sleeve 44. FIG. 5 shows a transverse sectional view of the clamping chuck 48. The clamping chuck 48 has a plurality of slits 49, so its diameter can be reduced.

When the diameter of the clamping chuck 48 is reduced, the clamping chuck 48 is capable of clamping the end section 18*a* of the tube 18, which has been expanded.

The diameter of the clamping chuck 48 can be reduced by a clamp sleeve 50, which is slidably attached on an outer circumferential face of the clamping chuck 48. Namely, the diameter of the clamping chuck 48 having the slits 49 is reduced by the clamp sleeve 50 when the clamp sleeve 50 is moved downward. During the downward movement, an inner tapered face 52, which is formed in an inner lower end section of the clamp sleeve 50, contacts an outer tapered face 51A of a tapered section 51, which is radially projected outward from a lower end of the clamping chuck 48. With the diameter reduction of the clamping chuck 48, the expanded upper end section 18*a* can be held.

Preferably, a length of the lower end section of the clamping chuck, 48, including the tapered section 51, is designed to projected from the lower end of the clamp sleeve 50, when the clamping chuck 48 is attached to the chuck holder 46. As shown in FIG. 3, a bottom face of the clamping chuck 48, which is projected from the lower end of the clamp sleeve 50, presses against the end plate 12*a*. This pressing results in the projected length of the upper end section 18*a* of the tube 18 from the end plate 12*a* being a prescribed length.

The chuck holder 46, to which the clamping chuck 48 is screwed, is attached to the base table 38 shown in FIG. 1 and capable of vertically sliding along the chuck holder 46.

Figure 6:
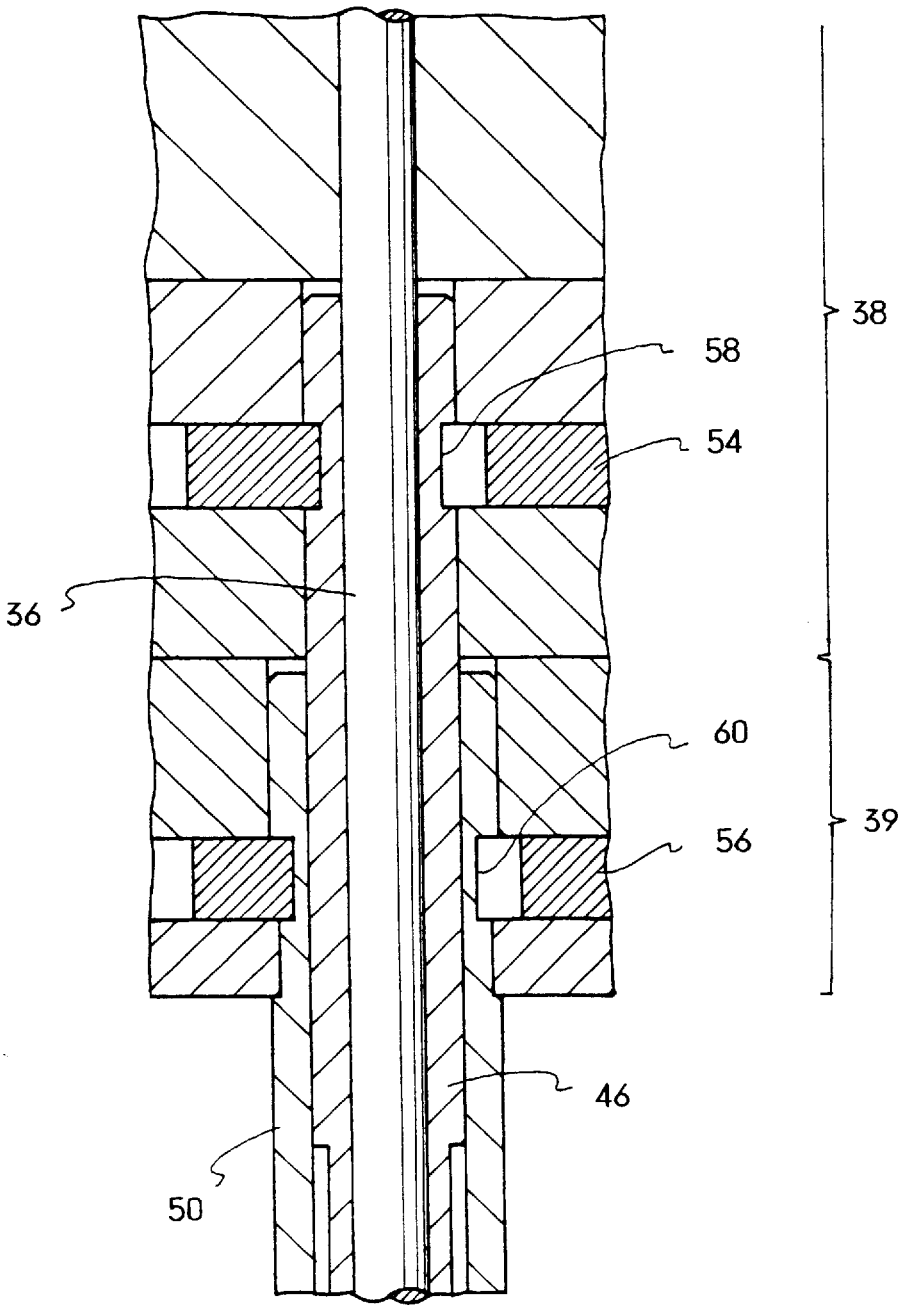
FIG. 6 is a partial sectional view showing a connecting mechanism among the holding unit shown in FIG. 3, a base table and a movable plate.

FIG. 6 shows a state in which the chuck holder 46 and the clamp sleeve 50 are attached. In FIG. 6, the chuck holder 46 is attached to a part of a clamp plate 54, which is provided in the base table 38 and capable of reciprocatively moving in a direction perpendicular to the mandrel 36. The chuck holder 46 is attached by fitting the part of the clamp plate 54 in a circular groove 58, which is formed on an outer circumferential face of an upper end section of the chuck holder 46.

The clamp sleeve 50 is attached to a movable plate 39, which is vertically moved by a driving cylinder (not shown). Namely, the clamp sleeve 50 is attached to the movable plate 39 by fitting a part of a clamp plate 56, which is provided in the movable plate 39 and capable of reciprocatively moving in the direction perpendicular to the mandrel 36, in a circular groove 60, which is formed on an outer circumferential face of an upper end section of the clamp sleeve 50.

The clamp plates 54 and 56 may be driven by one or two driving cylinders.

When the heat exchanging tubes 18 of the piled body 16 are expanded, firstly the press board 34 is moved downward by the hydraulic cylinders 30 (see FIG. 1). The base table 38 is moved downward together with the press board 34.

With the downward movement of the base table 38, the movable plate 39 is also moved downward, so the chuck holder 46, which is attached to the base table 38, and the clamp sleeve 50, which is attached to the movable plate 39, are moved downward. Then, the lower end face of the clamping chuck 48, which is attached to the chuck holder 46, contacts and presses the end plate 12*a* (see FIG. 3). The downward movement of the base table 38 is stopped by the balance cylinders 37 (see FIG. 1) when the length of the upper end section 18*a* of the tube 18 is made the prescribed length.

When the downward movement of the base table 38 is stopped, the front end section 44*b* of the inner sleeve 44 is in the upper end section 18*a* of the tube 18 as shown in FIG. 3. The bullet 42 for expansion is stayed in the tapered section 44*c* of the inner sleeve 44.

Figure 7:
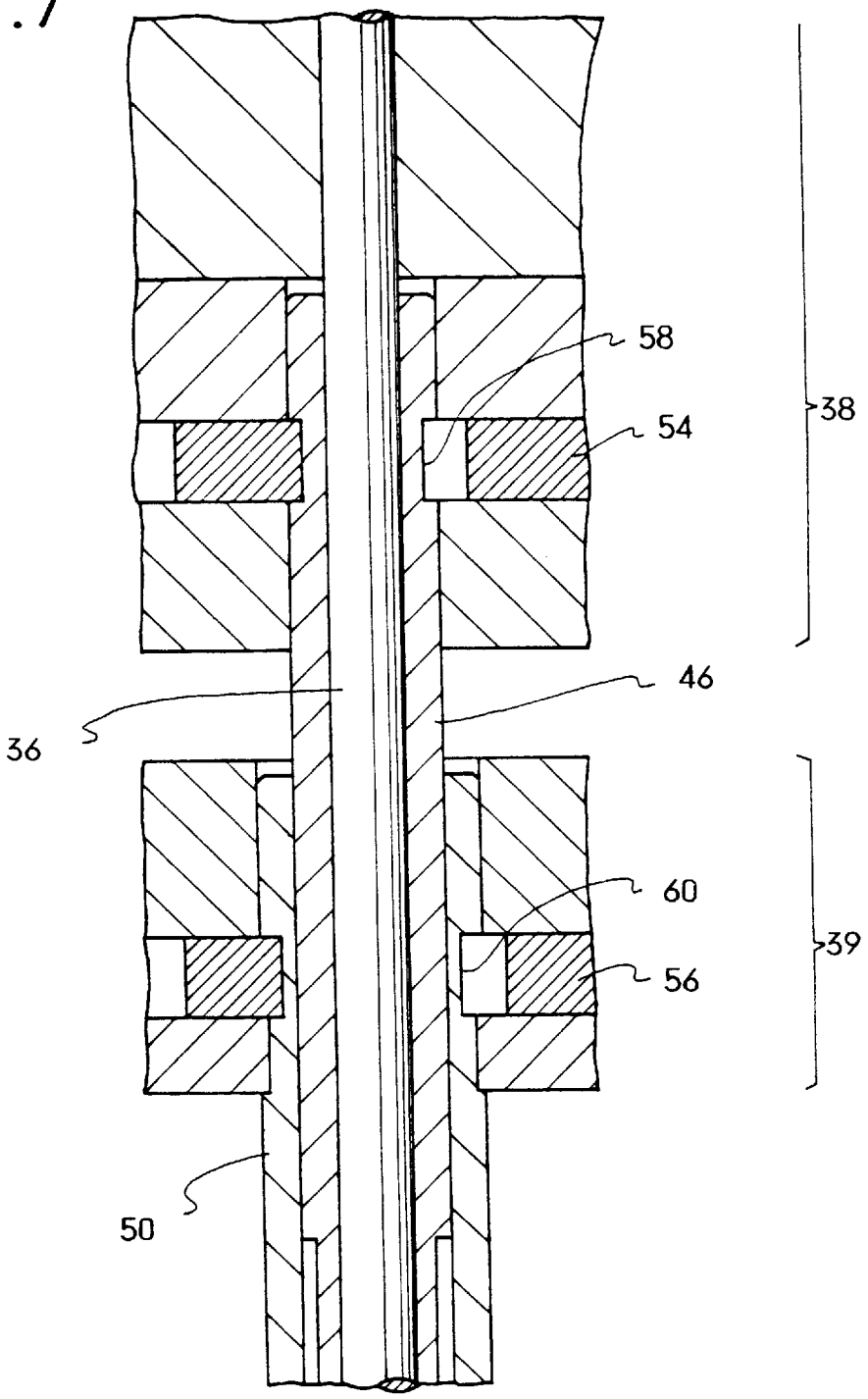
FIG. 7 is a partial sectional view showing a state in which the movable plate shown in FIG. 6 has been moved.

Next, the movable plate 39 is moved downward until reaching a prescribed height by the driving cylinder (see FIG. 7). The inner tapered face 52 of the clamp sleeve 50 contacts the tapered face 51A of the tapered section 51 to reduce the diameter of the clamping chuck 48 having the slits 49, until the diameter reaches the prescribed diameter.

Figure 8:
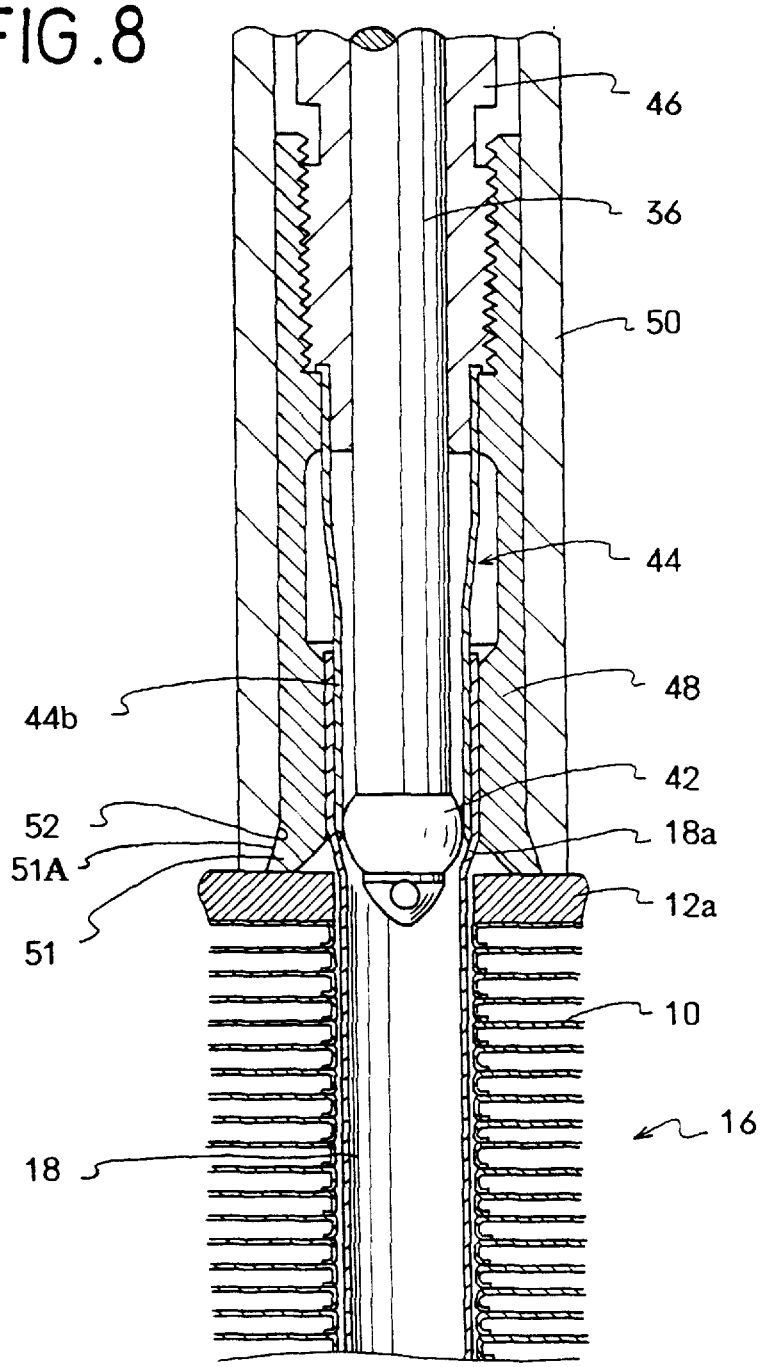
FIG. 8 is a partial sectional view showing a state in which a bullet is inserted in the first projected section of the tube, which is projected from a one end face of the piled body.

Afterwards, the press board 34 (see FIG. 1) is moved downward so as to insert the bullet 42, which is attached to the lower end of the mandrel 36, into the upper end section 18*a* of the tube 18. When the bullet 42 is inserted, the front end section 44*b* of the inner sleeve 44 is also expanded as shown in FIG. 8, so the inner diameter of the upper end section 18*a* is made greater than the outer diameter of the bullet 42. Thus, the outer circumferential face of the upper end section 18*a* is pressed onto the inner face of the clamping chuck 48, whose inner diameter has been reduced by the clamp sleeve 50, so that the upper end section 18*a* expanded is tightly held or clamped by the clamping chuck 48.

While the upper end section 18*a* is expanded, the bullet 42 expands the inner diameter of the upper end section 18*a* with the front end section 44*b* of the inner sleeve 44, so the bullet 42 does not directly contact an inner circumferential face of the upper end section 18*a*. Thus, no thrust force for moving the bullet downward works against the tube 18. The upper end section 18*a* is expanded by a radially expanding force only.

Figure 9:
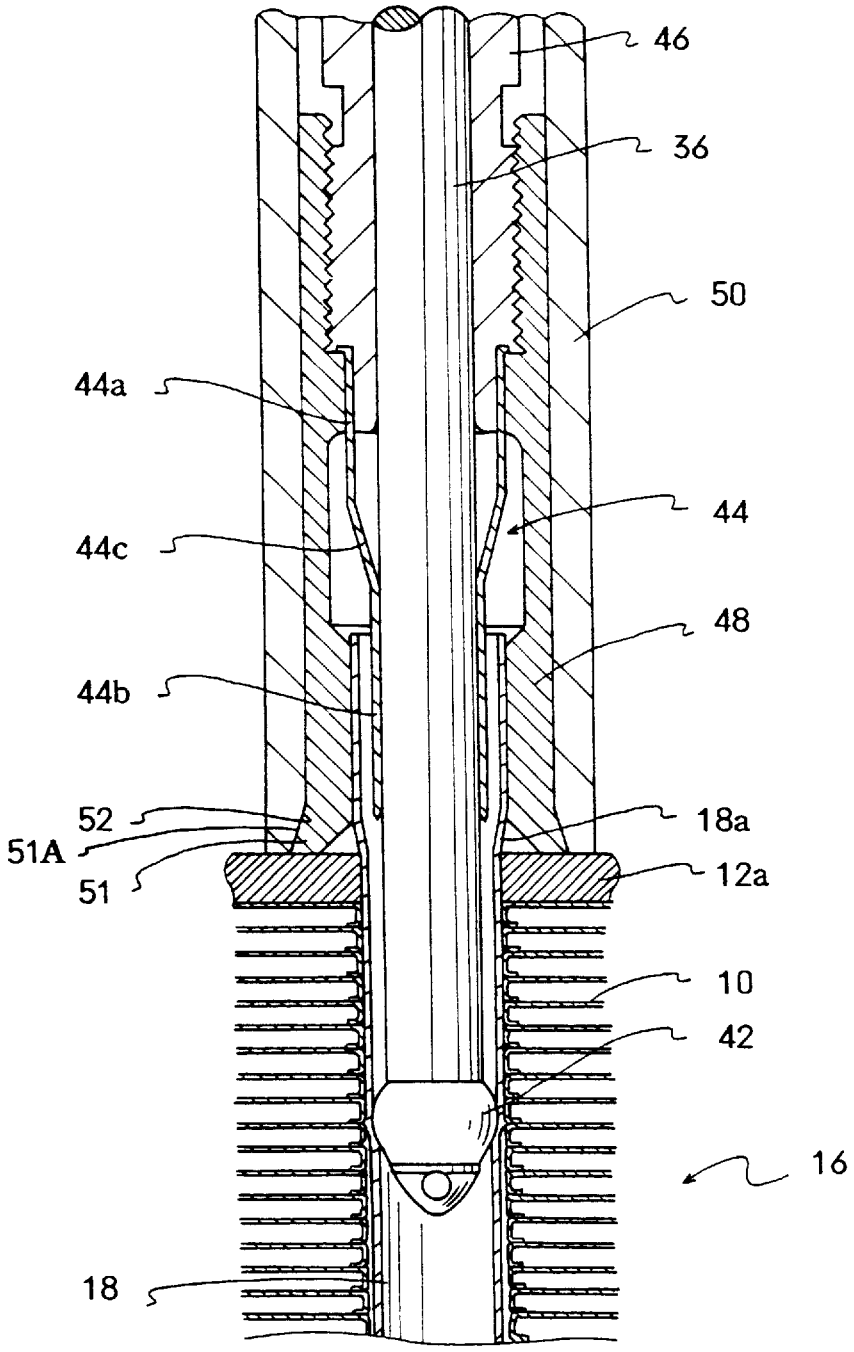
FIG. 9 is a partial sectional view showing a state in which the bullet has passed through the first projected section of the tube and reached a mid section thereof in the piled body.

In the tube expander of the present embodiment, the press board 34 is further moved downward after the upper end section 18*a* of the tube 18 is expanded. During the further movement of the press board 34, a mid part of the tube 18, which is in the piled body 16, is expanded by the passing bullet 42, as shown in FIG. 9.

While expanding the mid part of the tube 18, the bullet 42 directly contacts the inner face of the tube 18. Therefore, the downward thrust force works against the tube 18. But the upper end section 18*a* is tightly held by the clamp sleeve 50 and the clamping chuck 48, so little thrust force works against the U-shaped part of the tube 18.

Figure 10:
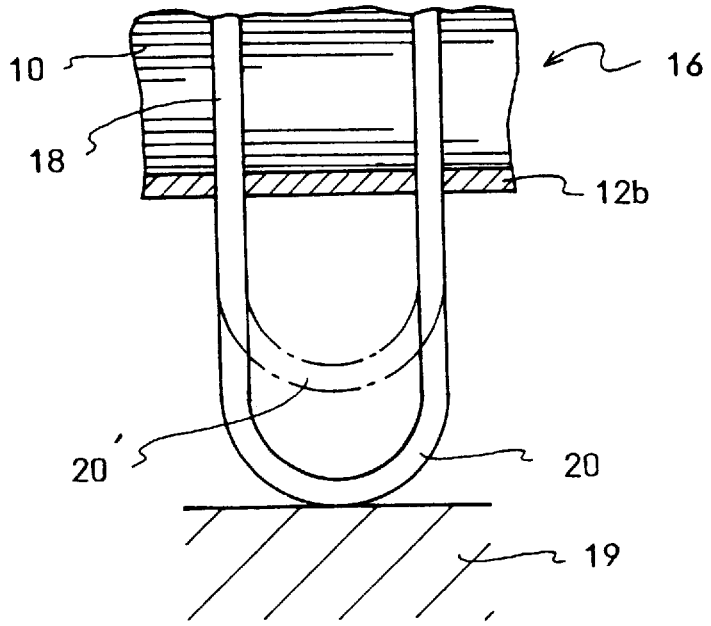
FIG. 10 is a view showing a contraction state of a U-shaped part of the tube.

While expanding the tube 18, a part of the tube 18 contracts with the expansion. Since the upper end section 18*a* of the tube 18 is tightly held or clamped, the U-shaped section 20, which is projected beyond the end plate 12*b*, contracts as shown by reference numeral 20' in FIG. 10. Namely, the projected length of the U-shaped part 20 is shortened.

Note that, the diameter of the front end section 44*b* of the inner sleeve 44, which has been enlarged by the bullet 42, is reduced by own elasticity, so that the front end section 44*b* contacts the outer circumferential face of the mandrel 36.

Since the contraction of the tube 18 is absorbed by shortening the projected length of the U-shaped part 20, displacement of the fins 10 caused by the contraction of the tube 18 can be prevented. By this, the adhesion of adjacent fins 10 and the irregurality of the fin clearance can be prevented.

Figure 15:
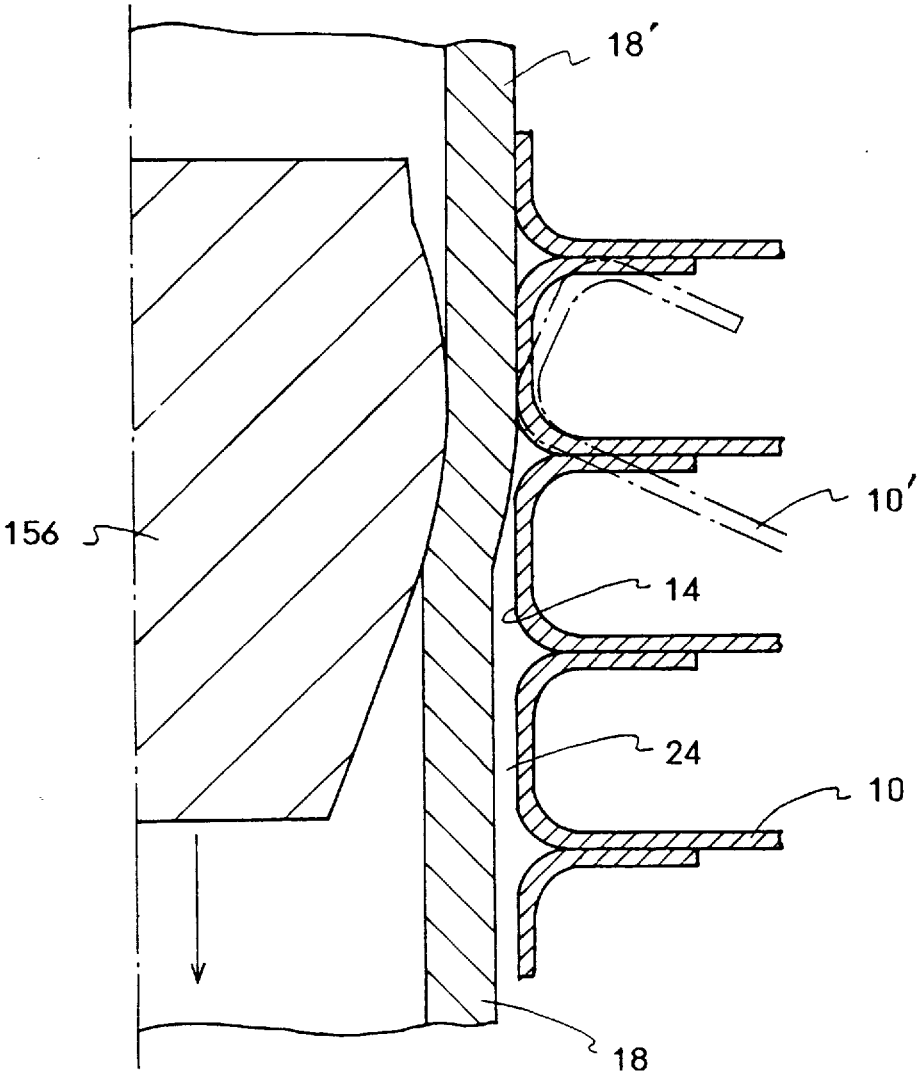
* and FIG. 15 is a view showing a state of adhesion of adjacent fins.

The U-shaped part 20 of the tube 18, which is capable of absorbing the tube contraction according to the tube expansion, is a non-expanded part, so there are gaps 24 between the outer circumferential face of the tube 18 and the inner face of each tube hole 14 of each fin 10 (see FIG. 15).

By the gaps 24, displacement of the fins 10 caused by the contraction of the U-shaped part 20 can be prevented.

After completing the tube expansion, the press board 34 is moved upward, so that the bullet 42 can be pulled out from the tube 18, which has been completely expanded. When the bullet 42 is pulled out from the tube 18, the bullet 42 increases the diameter of the front end section 44*b* of the inner sleeve 44 again as shown in FIG. 8. The bullet 42 then moves to the tapered section 44*c* of the inner sleeve 44. After the bullet 42 has passed the front end section 44*b*, the diameter of the front end section 44*b* of the inner sleeve 44 reduces its diameter by its own elasticity.

In the tube expander, the bullet 42 passes through the inner sleeve 44 again with being withdrawn. Therefore, it is preferable that the connecting section between the bullet 42 and the mandrel 36 smoothly introduce the bullet 42 into the front end section 44*b* of the inner sleeve 44.

Further, the upper end section 18*a* of the tube 18, which has been expanded, can be released by moving the movable plate 39 and the clamp sleeve 50 upward so as to open the clamping chuck 48. Then, the press board 34 is moved upward, and the clamping chuck 48 is also moved upward together with the base table 38, so that the upper end section 18*a* of the tube 18 comes out from the clamping chuck 48.

The upper end section 18*a*, which has come out from the clamping chuck 48 is expanded to enable attachment of the U-bent tube 22 (see FIG. 12). The secondary expansion or the second treatment for the upper end section 18*a* can be omitted. Namely, a flare section can be formed at the upper end section 18*a* without the second treatment.

The contraction rate of the tube 18 in the tube expander of the present embodiment is about 1.5%, which is less than that of the conventional tube expander (about 3.0%).

Therefore, material waste of the tubes can be reduced.

While the tube 18 is expanded, the upper end section 18*a* of the tube 18 does not contract. Therefore, the projected length of the upper end section 18*a* from the end plate 12*a* is always fixed to the length which is initially defined by the clamping chuck 48. Thus, the projected length of each upper end section 18*a* of the tubes 18 can be easily made equal.

The holding plate 19 for receiving the U-shaped parts 20 (the second projected section) of the tubes 18 may be flat. Therefore, so the same plate 19 can be used even if a pitch or a shape of the tubes 18 is changed.

In the tube expander shown in FIG. 3, the inner face of the clamping chuck 48 is a smooth face (see FIGS. 8 and 9), and the outer circumferential face of the upper end section 18*a* of the tube 18 is tightly held or clamped by the smooth inner face of the clamping chuck 48 with the clamping force caused by the clamp sleeve 50. During the tube expansion, the clamping chuck 48 rarely slips on the outer circumferential face of the upper end section 18*a* because of the downward thrust force caused by the bullet 42.

Figure 11:
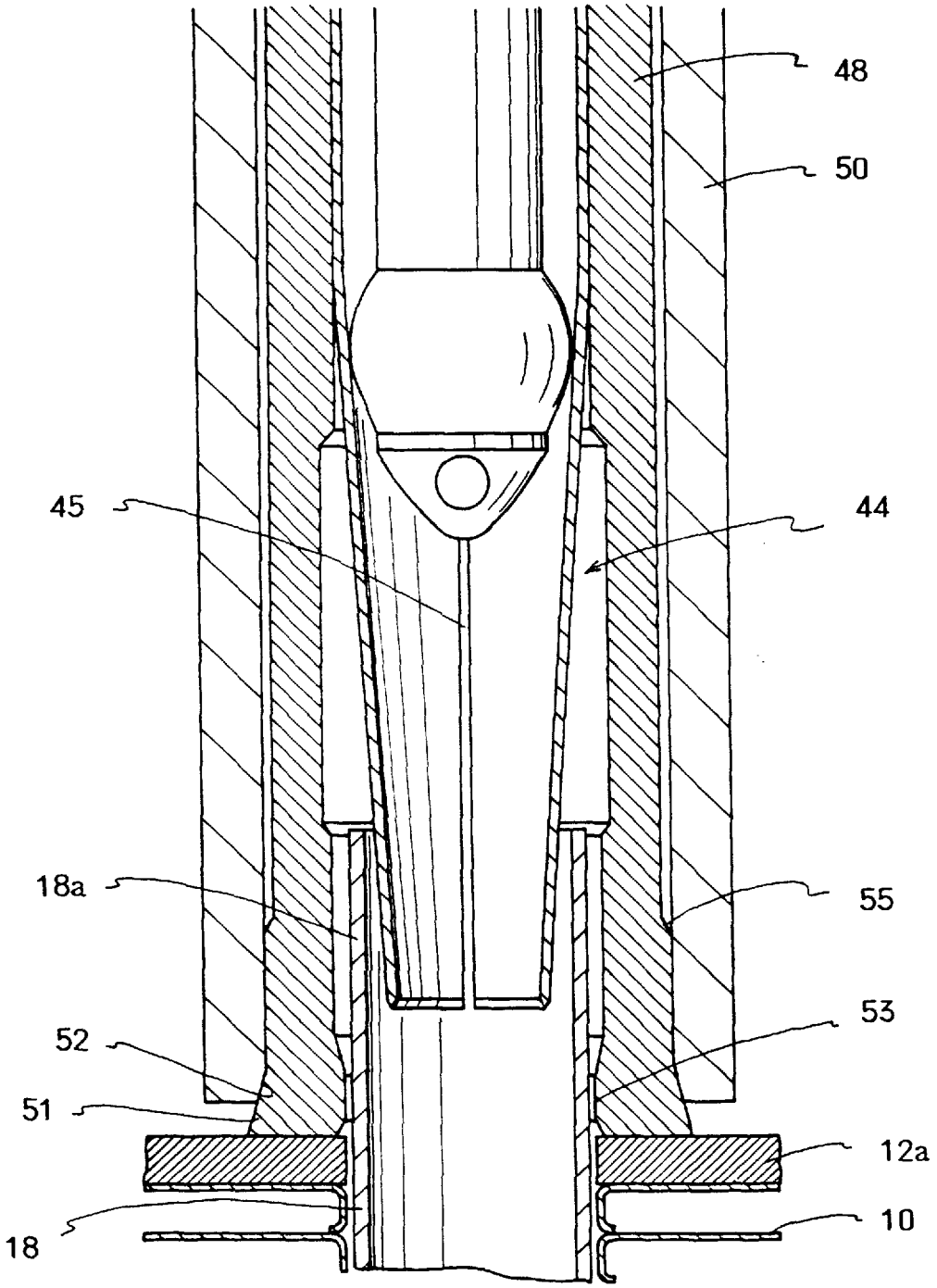
FIG. 11 is a partial sectional view of another example of the holding unit for holding the first projected section of the tube.
Figure 13A:
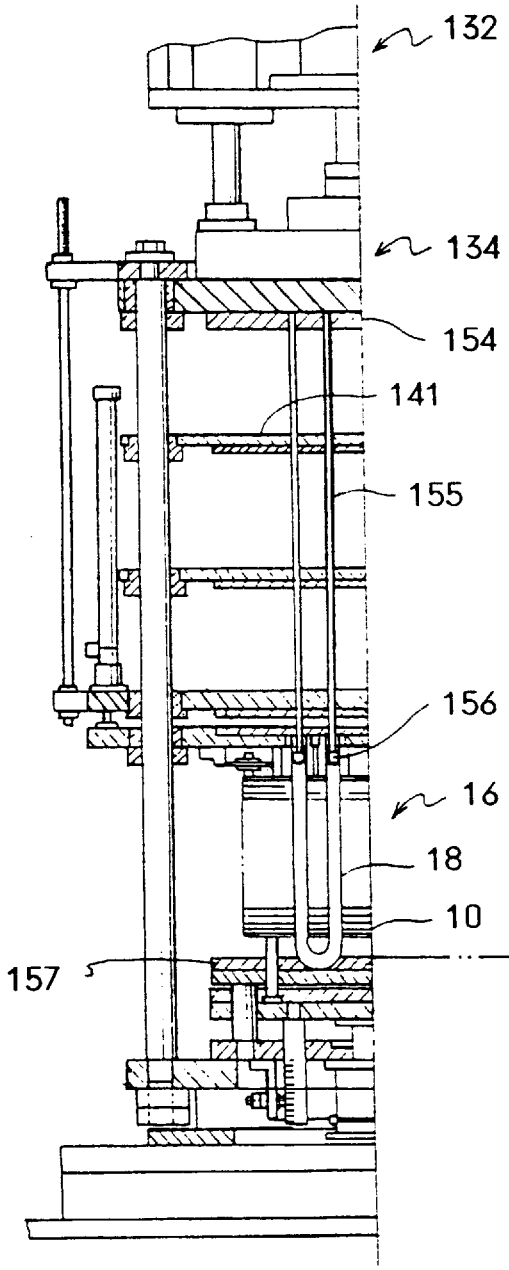
FIG. 13A PRIOR ART
FIGS. 13A and 13B are partial sectional views of the conventional tube expander.
Figure 13B:
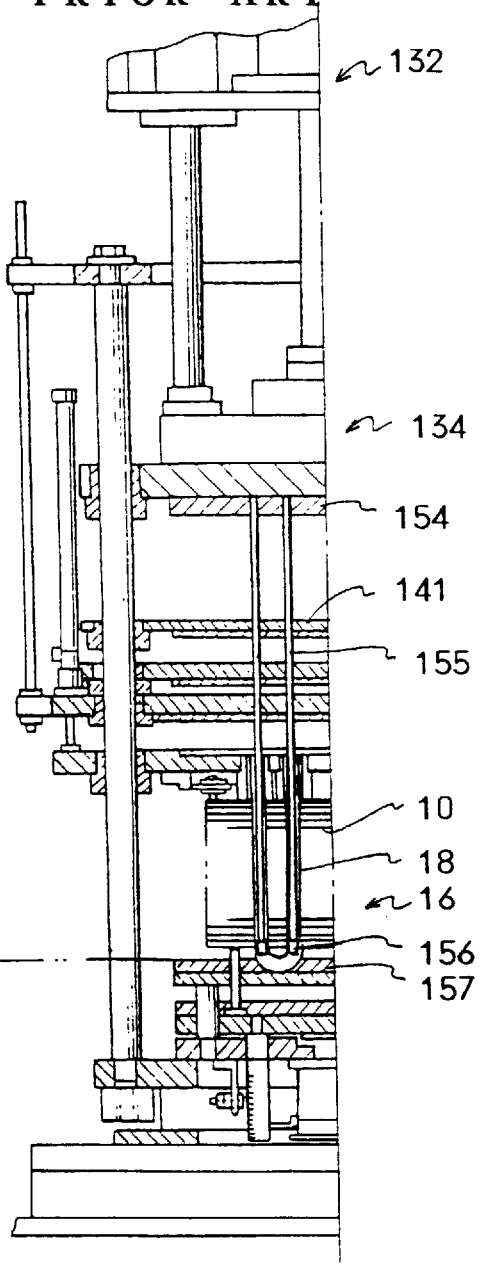
FIG. 13B PRIOR ART
Figure 14A:
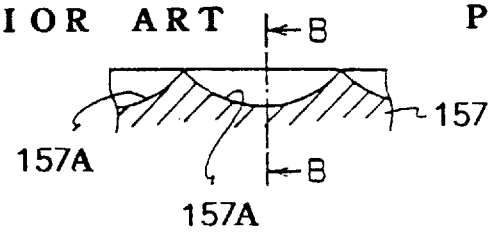
FIG.14A PRIOR ART
FIGS. 14A and 14B are partial sectional views of a holding plate of the conventional tube expander shown in FIGS. 13A and 13*b.
Figure 14B:
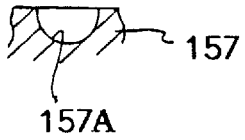
FIG.14B PRIOR ART

In FIG. 11, a projected section 53 is projected radially inward from the inner face of the clamping chuck 48 so as to prevent such slip. The projected section 53 is capable of contact with the outer circumferential face of the upper end section 18*a*. With this structure, the projected section 53 applies a drag force, which clamps the upper end section 18*a* against the downward thrust force caused by the bullet 42, to prevent such slip.

Note that, the projected section 53 is preferably provided in the lower end section of the clamping chuck 48. A plurality of projected sections may be arranged with separation, but the circular projected section 53 is preferable to make an external appearance of the upper end section 18*a* of the tube 18 good.

In FIG. 11, the projected section 53 is formed in the inner face of the clamping chuck 48, so the front end of the inner sleeve 44 locates short of the projected section 53. With this structure, an inserting part of the inner sleeve 44, which is inserted into the upper end section 18*a* of the tube 18, is shorter than that of the example shown in FIG. 3. Therefore, the upper end section 18*a*, whose inner diameter is greater than the outer diameter of the bullet 43 and which acts as the connecting section for the U-bent tube 22 (see FIG. 12), is also made short. If the expanded section 18*a* is short, cracks, which are formed while expanding the section 18*a*, can be reduced. Preferably, the length of the inserting part of the inner sleeve 44 is designed to make the upper end section 18*a* as short as possible, however the upper end section 18*a* must have enough length to allow for an adequate connection of the U-bent tube 22.

Further, as shown in FIG. 11, the shape of the lower end section of the inner sleeve 44 may be formed into a tapered shape, whose diameter is gradually made smaller toward the lower end. Compared with the embodiment shown in FIG. 3, in which the inner diameter of the inner sleeve 44 is immediately reduced in the tapered section 44*c*, the inner sleeve 44 shown in FIG. 11 is able to smoothly expand the upper end section 18*a*, so the forming of cracks can be effectively prevented.

In the present invention, the diameter of the clamping chuck 48 is reduced by the clamp sleeve 50, which slidably covers the clamping chuck 48. The clamp sleeve 50 may partially contact the clamping chuck 48. In this case, a part of the outer circumferential face of the clamping chuck 48 is radially projected outward as a projected part 55. The projected part 55 slidably contacts the inner face of the clamp sleeve 50. Preferably, the projected part 55 is formed on the outer circumferential face of the clamping chuck 48 corresponding to the upper end section 18*a* of the tube 18, which has been inserted therein.

In the above described embodiments, the bullets 42, etc. are vertically moved to expand the heat exchanging tubes 18, but the present invention can be applied to the tube expander, in which the bullets 42, etc. are moved horizontally. Further, the present invention can be applied to straight heat exchanging tubes instead of the U-shaped tubes 18.

In the present invention, adhesion of adjacent fins and irregularity of fin clearance can be prevented while the heat exchanging tubes are expanded. By the present invention production of bad heat exchangers can be reduced.

The contraction rate of the heat exchanging tube can be made lower, so that the material waste of the tubes can be reduced.

Further, the projected length of the one end sections (the first projected sections) of the tubes can be easily made equal. Equal lengths of projection allow the U-bent tubes to be connected automatically.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. In a tube expander having a mandrel, a bullet connected to one end of the mandrel, wherein the bullet is provided to expand a diameter of a heat exchanging tube, which is projected through holes in a plurality of stacked fins, so that the tube is integrated to the fins as the diameter of the tube is expanded, wherein the improvement comprises:

holding means for holding an end of the tube into which the bullet is first inserted;

pressing means for pressing the mandrel so that the bullet is moved from the end of the tube into which the bullet is first inserted toward another section of the tube which is extended beyond the stacked fins; and an inner sleeve having one end for insertion into the end of the tube into which the bullet is first inserted and another end fixed to the holding means.

2. The tube expander according to claim 1, wherein the inner sleeve includes a resilient portion capable of changing diameter as the bullet passes through the resilient portion, wherein the end of the tube into which the bullet is first inserted has its diameter expanded to a diameter of the bullet plus a thickness of walls of the inner sleeve.

3. The tube expander according to claim 2, wherein the inner sleeve includes a slit in a wall of the sleeve, the slit extending from the one end of the inner sleeve toward a midportion of the inner sleeve.

4. The tube expander according to claim 1, wherein the holding means comprises:

a clamping chuck substantially in the form of a cylinder having an outer circumferential face; and a clamping sleeve slideably mounted on the outer circumferential face of the clamping chuck, the clamping sleeve being capable of sliding to a first position on the clamping chuck and causing a diameter of the clamping chuck to be reduced, wherein the clamping chuck holds the end of the tube into which the bullet is first inserted when the clamping sleeve is slid to the first position.

5. The tube expander according to claim 4, wherein the clamping chuck includes a slit in the outer circumferential face, the slit extending from one end of the clamping chuck toward a midportion of the outer circumferential face, the outer circumferential face including an outwardly tapered portion, an inner wall of the clamping sleeve including an inwardly tapered portion, and wherein contact between the outwardly tapered portion and the inwardly tapered portion causes the clamping chuck to reduce in diameter and to thereby hold the end of the tube into which the bullet is first inserted.

6. The tube expander according to claim 4, wherein an inner face of the clamping chuck includes a projected section which extends radially inward from the inner face, the projected section contacting the end of the tube into which the bullet is first inserted when said clamping sleeve is slid to the first position so as to hold the end of the tube into which the bullet is first inserted.

7. The tube expander according to claim 6, wherein the clamping chuck includes a slit in the outer circumferential face, the slit extending from one end of the clamping chuck toward a midportion of the outer circumferential face, the outer circumferential face including an outwardly tapered portion, an inner wall of the clamping sleeve including an inwardly tapered portion, and wherein contact between the outwardly tapered portion and the inwardly tapered portion causes the clamping chuck to reduce in diameter and to thereby hold the end of the tube into which the bullet is first inserted.

* * * * *